US007540461B2

(12) United States Patent
Liang

(10) Patent No.: US 7,540,461 B2
(45) Date of Patent: Jun. 2, 2009

(54) QUICK CEILING FAN HOUSING AND CANOPY INSTALLATION ASSEMBLY

(75) Inventor: Hai Liang, Zhongshan (CN)

(73) Assignee: Hoo Cheung Group Ltd., Kowloon (HK)

( * ) Notice: Subject to any disclaimer, the term of this patent is extended or adjusted under 35 U.S.C. 154(b) by 96 days.

(21) Appl. No.: 11/638,735

(22) Filed: Dec. 14, 2006

(65) Prior Publication Data

US 2007/0090258 A1 Apr. 26, 2007

Related U.S. Application Data

(62) Division of application No. 10/659,196, filed on Sep. 9, 2003, now Pat. No. 7,168,670.

(51) Int. Cl.
*B42F 13/00* (2006.01)

(52) U.S. Cl. ..... 248/343; 416/5; 416/244 R; 403/348; 403/322.2; 248/342

(58) Field of Classification Search ..... 248/221.11, 248/222.11, 343, 342, 292.13, 344; 416/244 R, 416/5, 210 R; 403/348, 322.2, 325
See application file for complete search history.

(56) References Cited

U.S. PATENT DOCUMENTS 217,426 A * 7/1879 Taylor ..... 292/175
324,671 A * 8/1885 Drake ..... 220/759
1,194,636 A * 8/1916 Joy ..... 292/163
5,613,832 A * 3/1997 Su ..... 416/244 R
5,947,436 A * 9/1999 Bucher et al. ..... 248/345
6,042,072 A * 3/2000 Chi-Nan ..... 248/343
6,171,061 B1 1/2001 Hsu
6,171,062 B1 * 1/2001 Bucher et al. ..... 416/244 R
6,200,099 B1 3/2001 Liao
6,726,169 B1 * 4/2004 Tseng ..... 248/343

* cited by examiner

*Primary Examiner*—Kimberly T. Wood
(74) *Attorney, Agent, or Firm*—Frommer Lawrence & Haug LLP; Ronald R. Santucci

(57) ABSTRACT

A ceiling fan anchoring bracket and housing assembly for quick and easy installation of the ceiling fan housing for either hugger or down-rod fans is disclosed. The assembly comprises of hook-up pins and stationary lock-up pin fastened on and protruding from the anchoring bracket. The stationary lock-up pin latchingly locks the housing of the fan by spring or urging mechanism. The bracket and housing assembly enables the user to install the ceiling fan housing to the anchoring bracket without having to resort to using tools. All a user needs to do is to align and engage one side of the housing to the hook-up pins on the bracket and push the opposite side of the housing onto the stationary lock-up pin on the bracket through a spring action to complete the installation.

2 Claims, 13 Drawing Sheets

QUICK CEILING FAN HOUSING AND CANOPY INSTALLATION ASSEMBLY

CROSS-REFERENCE TO RELATED APPLICATION

This application is a division of U.S. patent application Ser. No. 10/659,196 filed Sep. 9, 2003 now U.S. Pat. No. 7,168,670 entitled "Quick Ceiling Fan Housing and Canopy Installation Assembly" the disclosure of which is incorporated herein in its entirety by reference.

FIELD OF THE INVENTION

This invention relates to a ceiling fan anchoring bracket and housing assembly for quick and easy installation of the ceiling fan housing for either hugger and down-rod mounted fans. The bracket and housing assembly enables the user to install the ceiling fan housing to the anchoring bracket with relative ease. By employing the inventive design of the bracket and housing assembly, users are only required to align and engage one side of the housing to the hook-up pins on the bracket and push the opposite side of the housing onto the stationary lock-up pin on the bracket through spring or urging action to complete the installation.

BACKGROUND OF THE INVENTION

Ceiling fans are very common household and commercial appliances. Conventional ceiling fan housings are difficult to install due to the installer having to perform a number of difficult manoeuvres. Installing a conventional ceiling fan housing usually requires the installer standing on a stool or scaffold trying to work overhead with aligning the holes on both the anchoring bracket and the housing and inserting screws into the holes and try to tighten the screws with screw drivers all at the same time. The relatively heavy motor housing and rotor components of the hugger mounted fans add to the installation difficulty. Moreover, the limited space for turning the screws below the ceiling makes the screw tightening extremely arduous. Such traditional ceiling fan housing installation method is evidently unsatisfactory. It requires the installer great dexterity, patience, efforts and time in order to securely install the motor housing to the anchoring bracket.

It is therefore highly desirable to eliminate the need to screw the ceiling fan housing to the anchoring bracket so that a user only needs to simply push and snap the housing and secure the housing to the bracket for ready use.

Attempts have been made to achieve this objective in the prior art. For example, U.S. Pat. No. 6,200,099 (issued to Liao on Mar. 13, 2001) discloses a mounting mechanism without the need to use screws. It provides a frame for anchoring to the ceiling. Two pairs of base plates are used to secure the frame to the corresponding lugs on the upper circumference of the motor housing through a gap and slots and a resilient member. Even the Liao method avoids resorting to utilizing screws, it appears to be equally complicated in the assembly process, especially given the limited working space below the ceiling. U.S. Pat. No. 6,171,061 (issued to Hsu on Jan. 9, 2001) teaches a suspending bracket for receiving a ceiling fan housing without the need of screws. The Hsu system is somewhat simpler than the Liao system. It provides two diagonally opposed spring-biased steel balls partially embedded half way inside the blind holes of an anchoring frame. There are two corresponding holes located on the inwardly extending lugs positioned along the top rim of the fan housing. During installation, a user presses the housing against the anchoring frame and rotates the housing until the holes on the lugs engaged with the two steel balls, thereby locking the housing in position. However, the constant vibration of the motor housing will cause the ball-and-hole locking mechanism to degenerate and deteriorate over time and pose the hazardous danger of disengaging the fan housing from the anchor frame. Accordingly, it is beneficial to develop a mechanism which eliminates the need to use screws to fasten the fan housing to the anchoring bracket and, at the same time, promotes ease of installation and ensure permanent locking security.

It is also advantageous to be able to disengage the housing from the anchor bracket with simple manoeuvres and without having the need to resort to special tools.

SUMMARY OF THE INVENTION

The present invention provides a ceiling fan anchoring bracket and housing assembly for quick and easy installation of the ceiling fan housing to the bracket. The bracket and housing assembly enables the user to latchingly engage the housing to the ceiling anchoring bracket by simple actions with relative ease and without the need to use any tool.

It is a principal object of the invention to provide an improvement in the mechanical structure of a ceiling fan anchoring bracket and housing assembly which can be readily coupled together securely. Such bracket and housing assembly can be used for both types of ceiling fans, namely hugger mounted and down-rod mounted fans. For hugger mounting, the present invention is used to install the motor housing onto the ceiling bracket. For down-rod mounting, the present invention is used to install the down-rod canopy onto the ceiling bracket.

Accordingly, the present invention provides for a hugger ceiling fan anchoring bracket and fan housing assembly comprising (i) a fan anchoring bracket comprising a hook-up means, a stationary lock-up means and a stationary locking device housing engaging flange, wherein the stationary lock-up means comprises a locking plate mounted on the anchoring bracket and a pin protruding therefrom through a coil spring; whereby a spring biasing action exerted by the lock-up means is achieved by the coil spring cooperatively urging the pin against a corresponding hole on the fan housing and wherein the pin engages a hole in the stationary locking device housing engaging flange; (ii) the hook-up means and stationary lock-up means are mountably attached to the fan anchoring bracket and the stationary lock-up means capable of exerting spring biasing action to lock the fan housing in a secure position; and (iii) the fan housing equipped with corresponding means for engaging the hook-up means.

The present invention also provides for a down-rod ceiling fan anchoring bracket and canopy assembly which comprises similar components as disclosed in the foregoing.

BRIEF DESCRIPTION OF THE DRAWINGS

Advantages and features of the invention will become more apparent with reference to the following description of the presently preferred embodiment thereof in connection with the accompanying drawings, wherein like references have been applied to like components, in which.

DETAILED DESCRIPTION OF THE PREFERRED EMBODIMENTS

The anchoring bracket and housing assembly of the present invention is comprised of three parts, namely a ceiling anchoring bracket, a housing locking device mounted on the anchoring bracket and a ceiling fan motor housing for hugger mounted fans or, in the case of down-rod mounted fans, a canopy for latchingly attaching to the anchoring bracket with the aid of the locking device.

Figure 1:
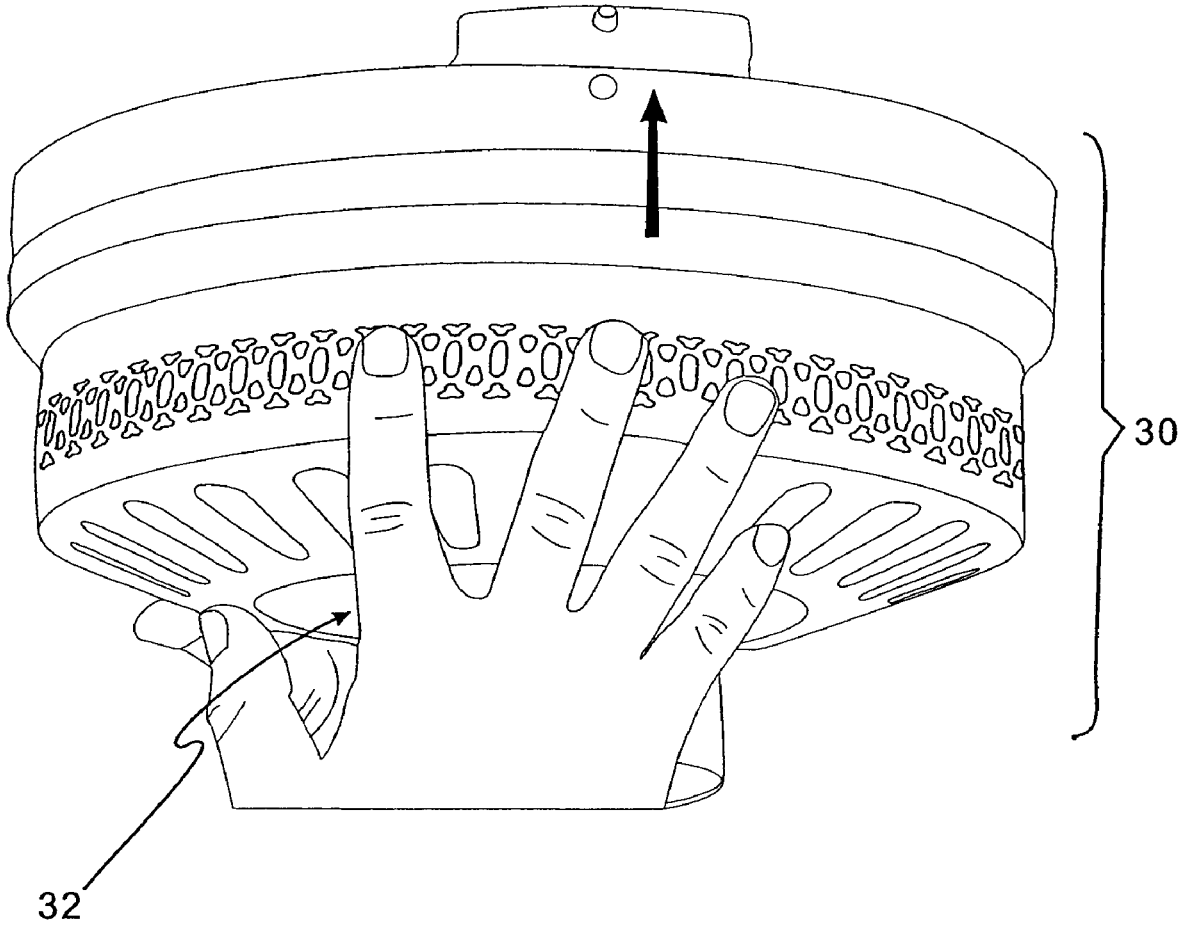
FIG. 1 shows a perspective view of a user installing a hugger mounted ceiling fan motor housing to the anchoring bracket of the present invention with a simple push-up movement.
Figure 7:
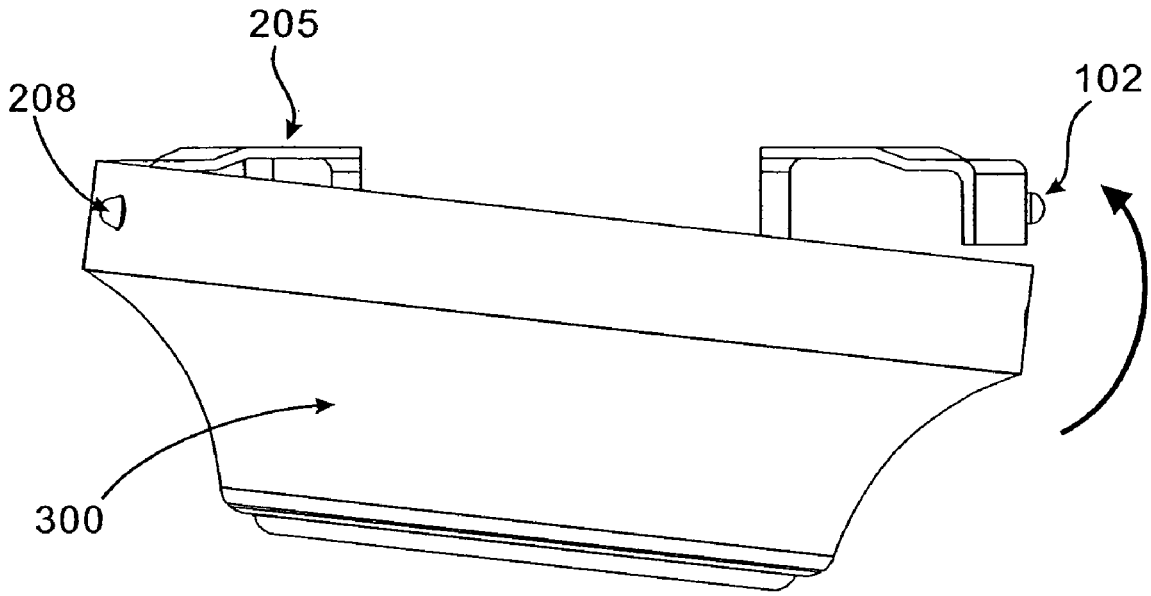
FIG. 7 shows a perspective view of a down-rod ceiling canopy being installed onto the anchoring bracket of the present invention with a simple push-up movement.

According to the present invention, a user can complete the housing installation of a hugger mounted fan by simply align and engage one side of the housing to the hook-up pins on the bracket and push the opposite side of the housing to securely latch onto the stationary lock-up pin on the bracket through a spring action (see FIG. 1). In the case of a down-rod mounted fan, the user can install the canopy to the ceiling anchoring bracket with similar latching manoeuvres (see FIG. 7). While the inventive concept for installing the motor housing (in the case of hugger mounted fans) and the canopy (in the case of down-rod mounted fans) is the same, for clarity of presentations, the two types of installations will be discussed separately below.

Hugger Mounted Fans

Figure 2A:
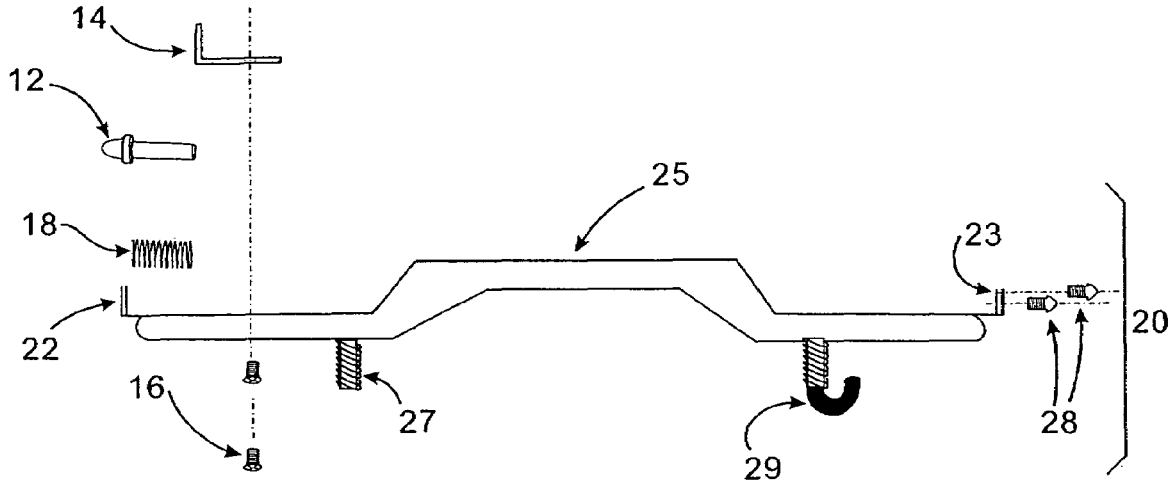
FIG. 2*a* shows a side view of the anchoring bracket of a hugger mounted ceiling fan with the components of the locking device and hook-up pins of the present invention.

Referring to FIG. 2*a*, an anchoring bracket 20 of the present invention is disclosed. The general shape of anchoring bracket 20 resembles a low-rise inverted "U" with the "wings" spreading out on both sides. The bracket has a ceiling anchoring plate 25 in the middle which is secured to the ceiling with conventional screws. There are a plurality of fan motor screws 27 provided on each side of ceiling anchoring plate 25. Anchoring plate 25 has an arc welded J-hook 29 for convenient circuit connection. The foregoing components are well taught in the prior art.

Figure 2B:
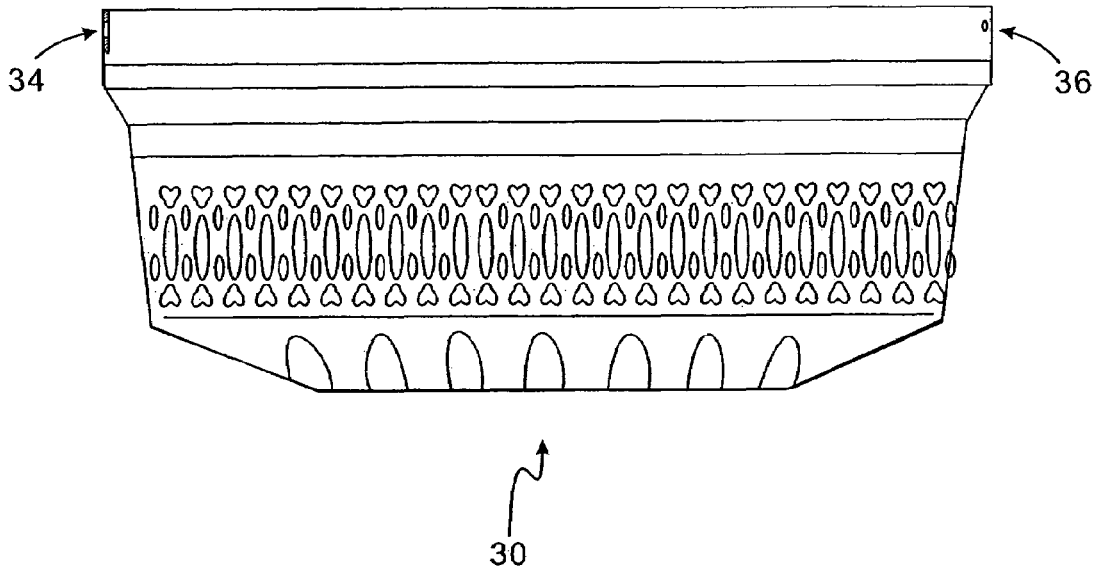
FIG. 2*b* shows a side view of the hugger mounted ceiling fan housing provided with stationary lock-up pin engaging hole and hook-up pin engaging hole.
Figure 3A:
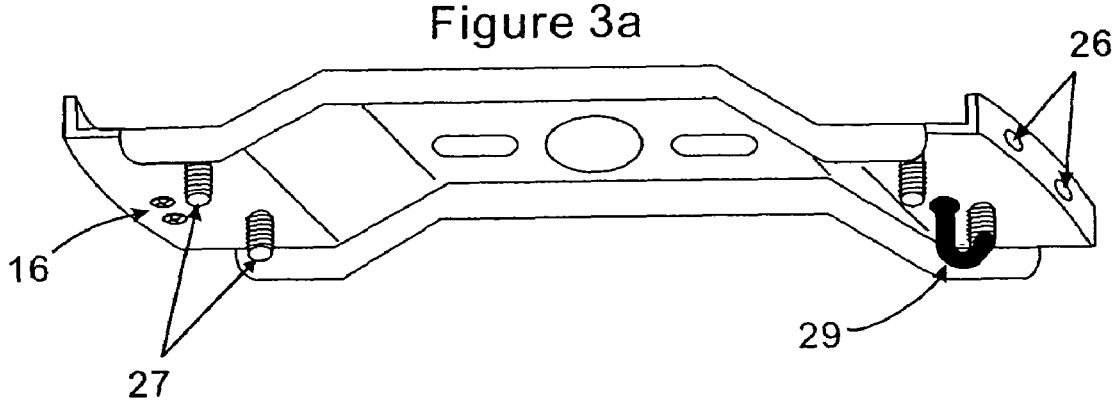
FIG. 3*a* shows a bottom perspective view of the anchoring bracket of a hugger mounted ceiling fan of the present invention with the locking device and hook-up pins mounted thereon.
Figure 3B:
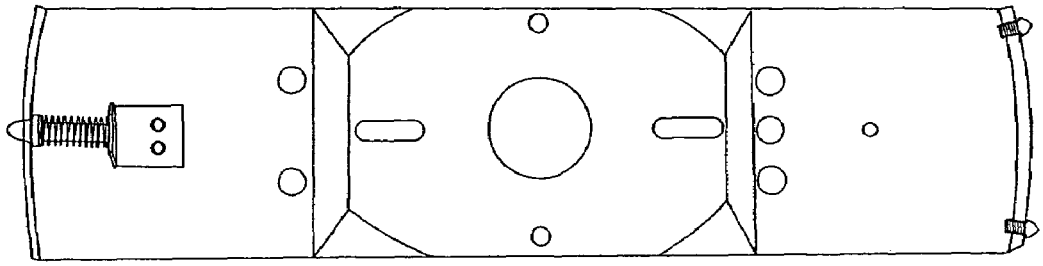
FIG. 3*b* shows a top plane view of the anchoring bracket of a hugger mounted ceiling fan of the present invention with the locking device and hook-up pins mounted thereon.
Figure 3C:
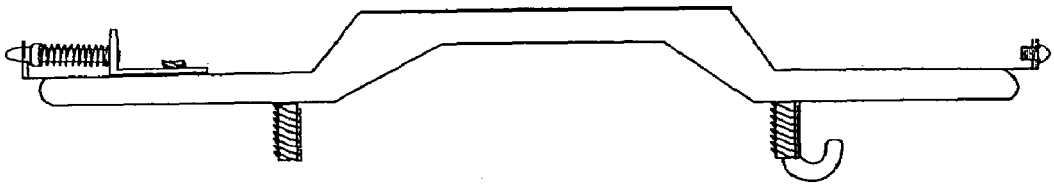
FIG. 3*c* shows a side view of the anchoring bracket of a hugger mounted ceiling fan of the present invention with the locking device and hook-up pins mounted thereon.

A slightly convexed flange is provided at each end of the "wings" of anchoring bracket 20. Each of the two ends of the "wings" is designated as the hook-up end and locking end, respectively. On the hook-up end, there is the hook-up pins housing engaging flange 23. Directly opposite to the hook-up end is the locking end and it provides the locking device housing engaging flange 22. According to one embodiment of the invention, two hook-up pin receiving holes 26 are located on flange 23 to receive hook-up pins 28 (see FIGS. 2*a* and 3*a*). Optionally, hook-up pins 28 (see FIG. 4*b*) may be screwed into holes 26 (see FIGS. 3*a* to 3*c*). The position of hook-up pins 28 corresponds to the hook-up pin engaging holes 36 on the motor housing 30 (see FIG. 2*b*).

Figure 3D:
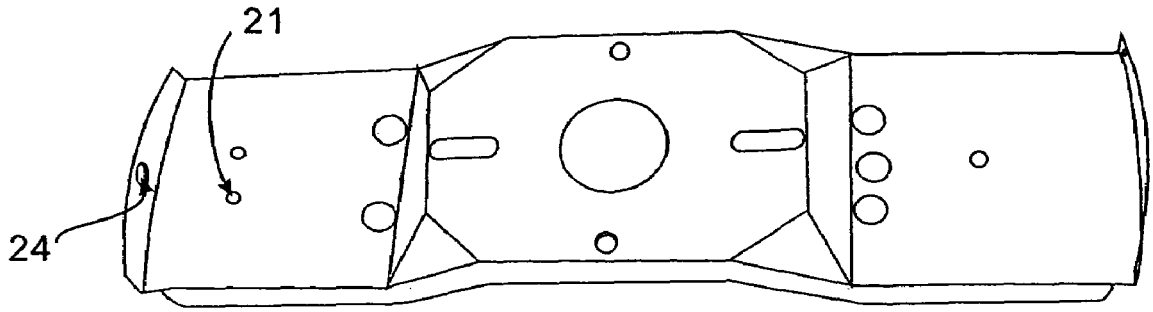
FIG. 3*d* shows a top perspective view of the anchoring bracket of a hugger mounted ceiling fan of the present invention without the locking device and hook-up pins.

On the locking device housing engaging flange 22, a stationary lock-up pin receiving hole 24 is provided at around the middle of flange 22 (see FIG. 3*d*). Hole 24 receives the head portion X of stationary lock-up pin 12, which latchingly engages to the lock-up engaging hole 34 on motor housing 30 (see FIG. 2*b*).

Figure 4A:
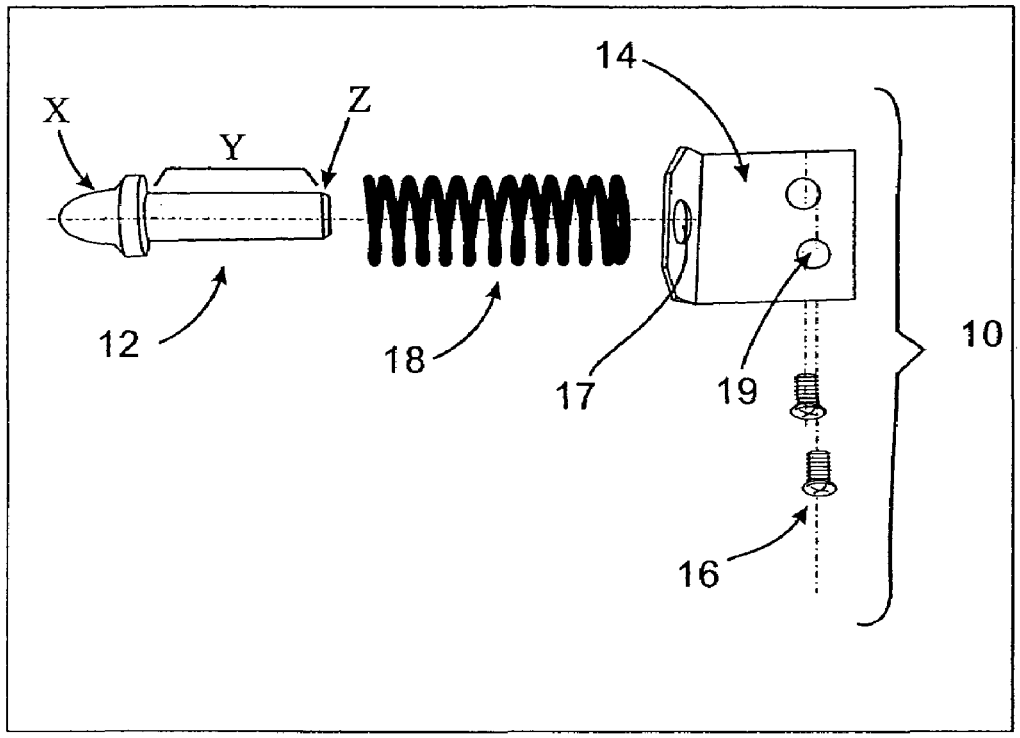
FIG. 4*a* shows an enlarged perspective view of the components of the locking device of the present invention for a hugger mounted ceiling fan.
Figure 4B:
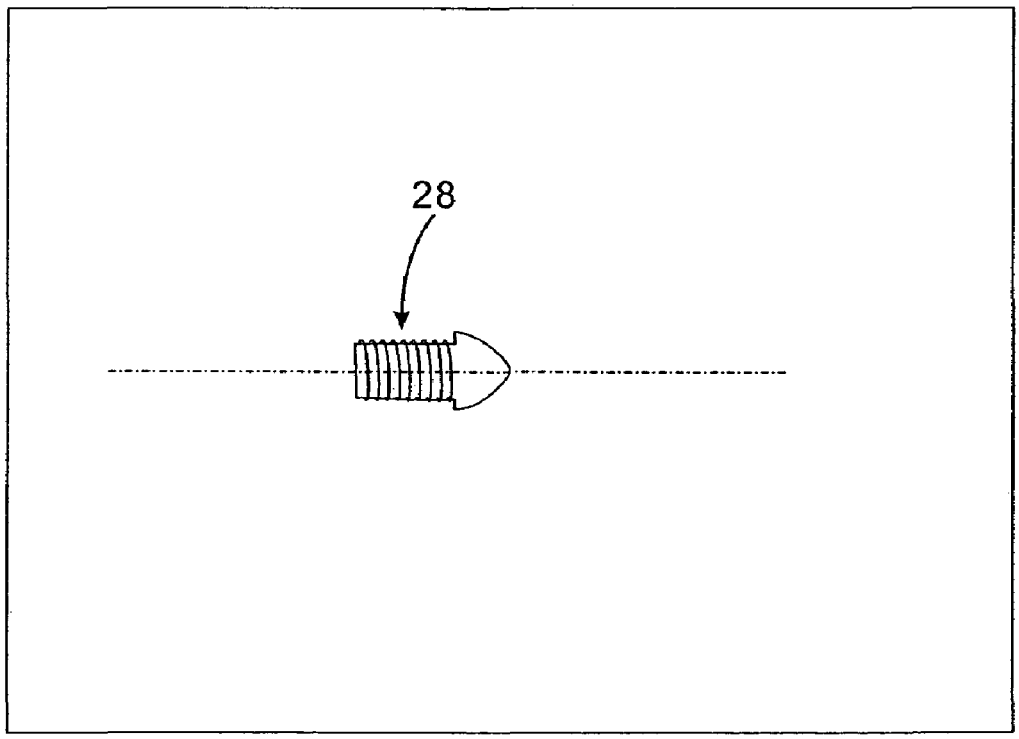
FIG. 4*b* shows an enlarged perspective view of the hook-up pin of the present invention.

The locking device 10 is now described with reference to FIG. 2*a* and FIG. 4*a*. The locking device 10 is comprised of a stationary lock-up pin 12 with a head portion X, a body portion Y and a relatively short tail portion Z. The head portion X takes the shape of a round-headed cone in order to facilitate and ease the sliding and latchingly engaging action of the motor housing 30 when said housing is coupled to the stationary lock-up pin 12. The base of the cone connects to body portion Y after passing a connector portion with larger diameter. The connector portion keeps the body portion Y inside the locking device housing engaging flange 22. The body portion Y is inserted into coil spring 18 which has an approximate length as portion Y. Since the dimension of the base of the head portion X is larger than the diameter of coil spring 18, the head portion X is exposed from spring 18 and protrudes outside the locking device housing engaging flange 22 through stationary lock-up pin receiving hole 24. However, the tail portion Z of stationary lock-up pin 12 extends beyond spring 18 and abuts against the stationary lock-up pin recess 17 located on the vertical wedge of the L-shaped locking plate 14. The L-shaped locking plate 14 is, in turn, mounted on the upper side of anchoring bracket 20 by locking plate screws 16 through locking plate screw holes 19 and unto bracket 20, through locking plate receiving holes 21 from below. FIGS. 3*a*, 3*b* and 3*c* illustrate the position of the locking device 10 relative to the other components on the anchoring bracket 20.

Figure 5A:
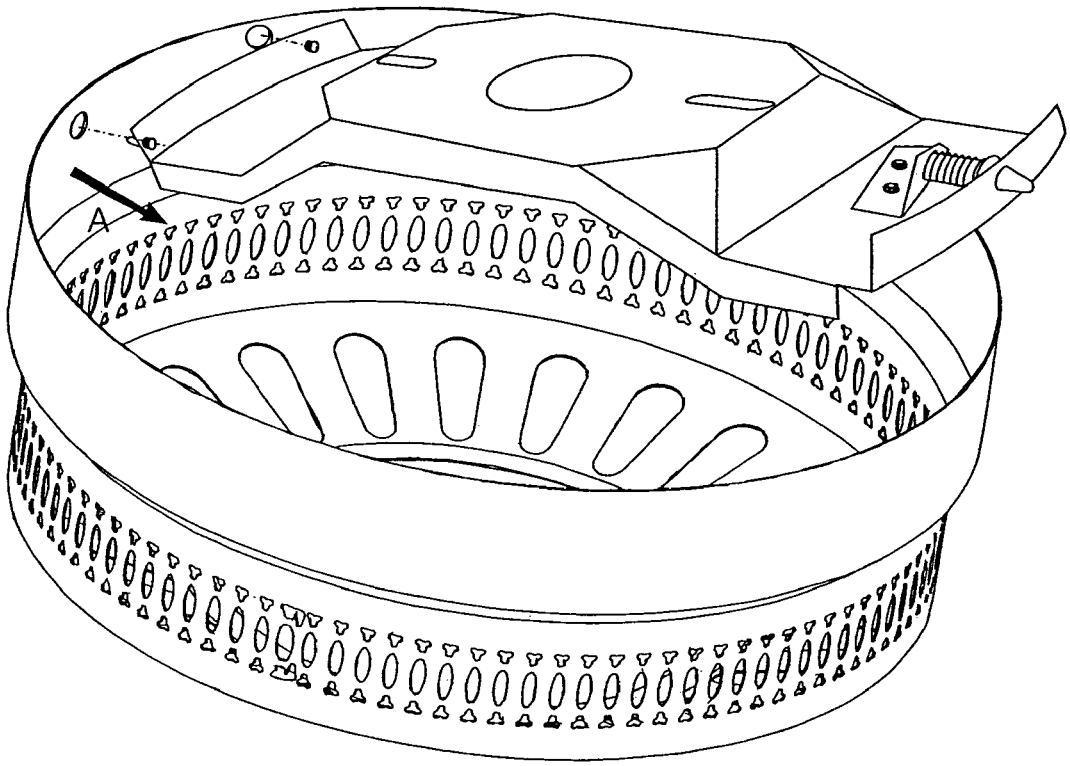
FIG. 5*a* shows the housing of a hugger mounted ceiling fan engaging into the hook-up pins of the present invention.
Figure 5B:
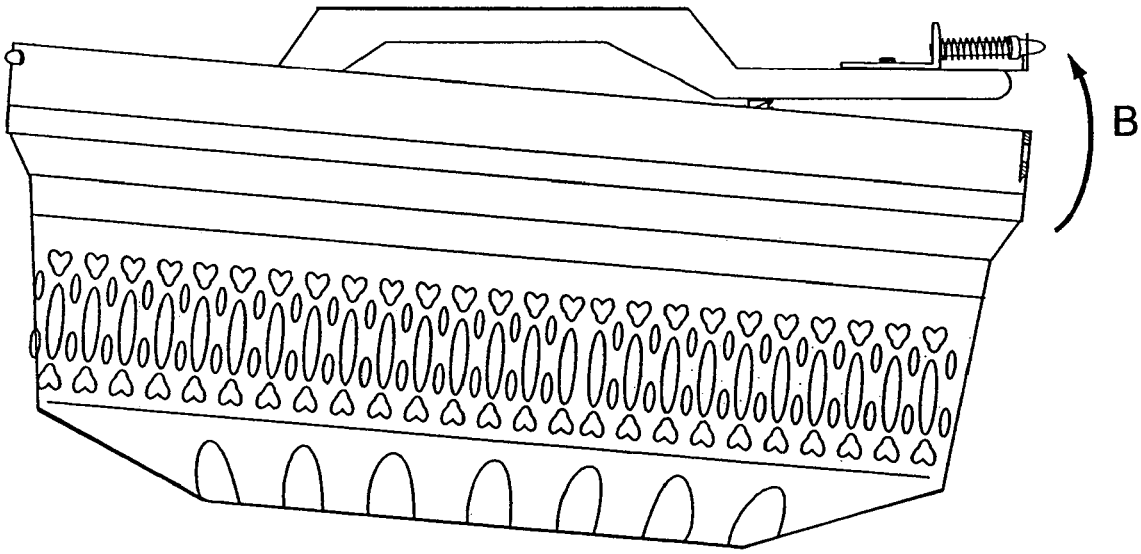
FIG. 5*b* shows the housing of a hugger mounted ceiling fan latchingly engaging into the stationary lock-up pin of the present invention.

FIGS. 5*a* and 5*b* illustrate the relatively easy installation of the ceiling fan motor housing 30 onto the anchoring bracket 20 by latchingly engaging the locking device 10 of the present invention. The user first aligns the two hook-up pin engaging holes 36 with the two hook-up pins 28 on ceiling anchoring plate 25 and moves the housing towards the plate (as in the direction indicated by arrow A in FIG. 5*a*) until the pins 28 are engaged to the holes 36. Once the hook up is completed, the user then proceeds to lock up the housing by pushing housing 30 upward (as in the direction indicated by arrow B in FIG. 5*b*). With the upward pushing motion, the stationary lock-up pin 12 latchingly engages hole 34 on the motor housing when the latter comes into contact with head portion X of stationary lock-up pin 12 on the anchoring bracket 20. Due to the round-headed cone shape of the head portion X of stationary lock-up pin 12, the rim of housing 30 forces the head portion X of stationary lock-up pin 12 to retract (as housing 30 is pushed up) and then to urge outward and to lock into stationary lock-up pin engaging hole 34 via the coil spring biasing action.

Figure 6:
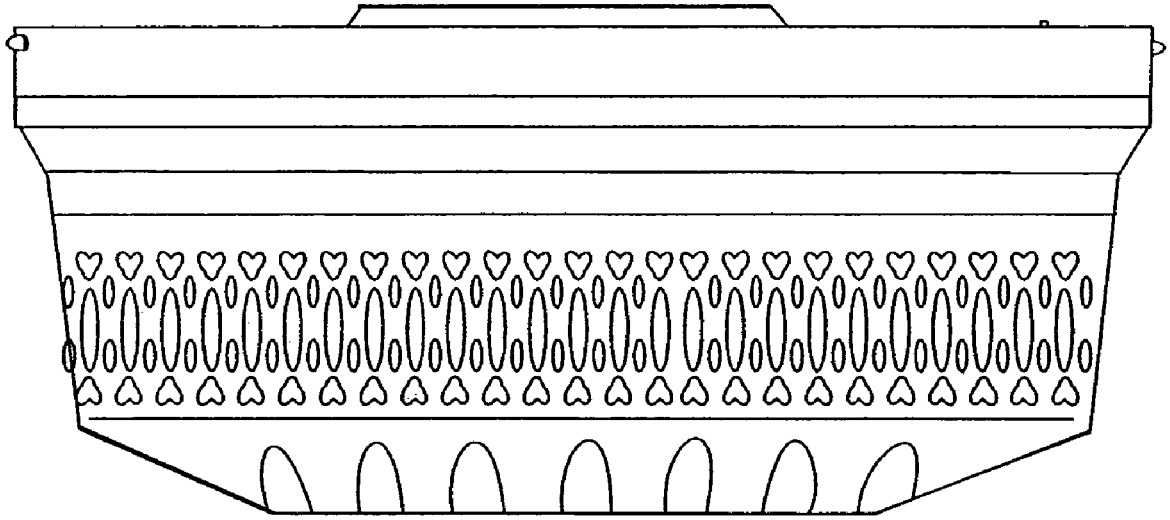
FIG. 6 shows the hugger mounted ceiling fan housing securely engaged into the anchoring bracket of the present invention.

FIG. 6 shows the ceiling fan motor housing 30 securely installed onto the anchoring bracket 20, with the hook-up pins 28 and head portion X of stationary lock-up pin 12 protruding outward from the hook-up pin engaging holes 36 and stationary lock-up pin engaging hole 34, respectively.

Down-Rod Mounted Fans

Inventive features of the present invention directed to the down-rod mounted type of fans are now described with reference to FIGS. 7 to 13*c*.

Figure 8A:
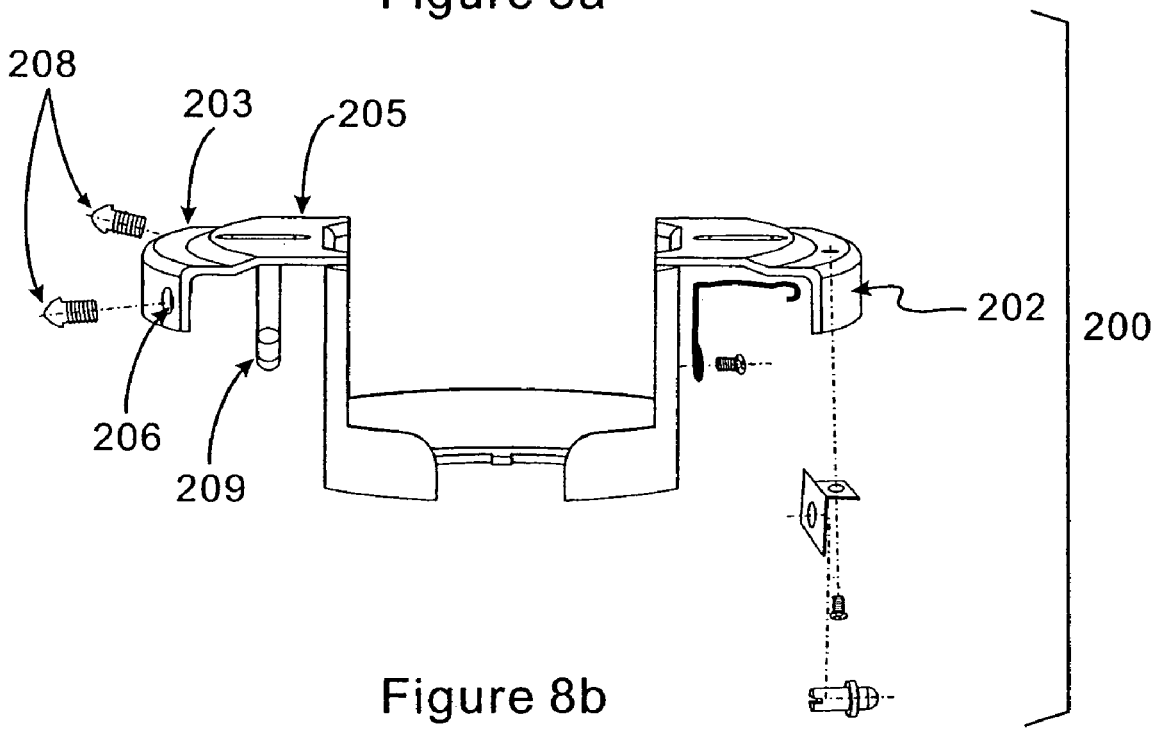
FIG. 8*a* shows a front and top perspective view of the anchoring bracket of a down-rod ceiling fan with the components of the locking device and hook-up pins of the present invention.
Figure 8B:
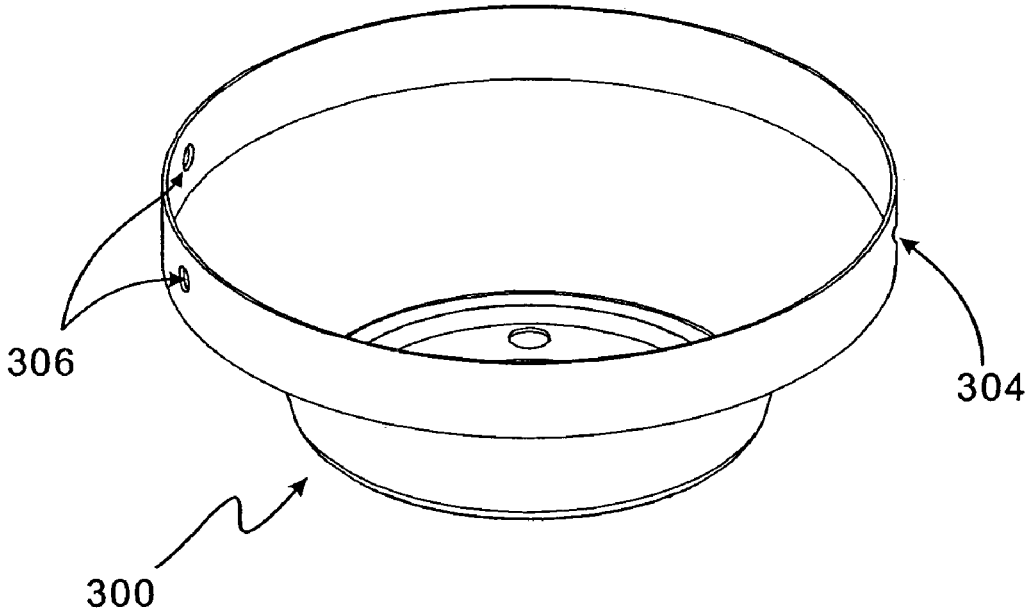
FIG. 8*b* shows a perspective view of the down-rod ceiling canopy provided with one stationary lock-up pin engaging hole and two hook-up pin engaging hole.

In FIGS. 8*a* and 8*b*, an anchoring bracket 200 suitable for use with down-rod mounted fan canopy 300 according to the present invention is disclosed. The anchoring bracket 200 takes the shape of an "U" with two ceiling anchoring plates 205 spreading out like a pair of "wings" on each side. At the bottom of the "U-shaped" bracket there is an opening for convenient placement of the down-rod (not shown). The ceiling anchoring plates 205 are used to secure the bracket to the ceiling using conventional screws. One of the anchoring plates 205 has an arc welded J-hook 209 for convenient circuit connection. As in the case of the hugger mounted fans, these components are known in the prior art.

A convexed flange is provided at the end of each of the "wings" of anchoring bracket 200. Each of the two ends of the "wings" is designated as the hook-up end and locking end, respectively. On the hook-up end, there is the hook-up pins canopy engaging flange 203. Directly opposite to the hook-up end is the locking end and it provides the stationary locking device canopy engaging flange 202. According to a preferred embodiment , two hook-up pin receiving holes 206 are located on flange 203 to receive hook-up pins 208 (see FIG. 8*a*). Optionally, hook-up pins 208 may be screwed into holes 206 (see FIG. 8*a*). The position of hook-up pins 208 corresponds to the hook-up pin engaging holes 306 on the down-rod canopy 300 (see FIG. 8*b*). FIGS. 9*a*, 9*b*, 9*c*, 9*d* and 9*e* illustrate the perspective, left, right, front and top views of the anchoring bracket 200.

Figure 9A:
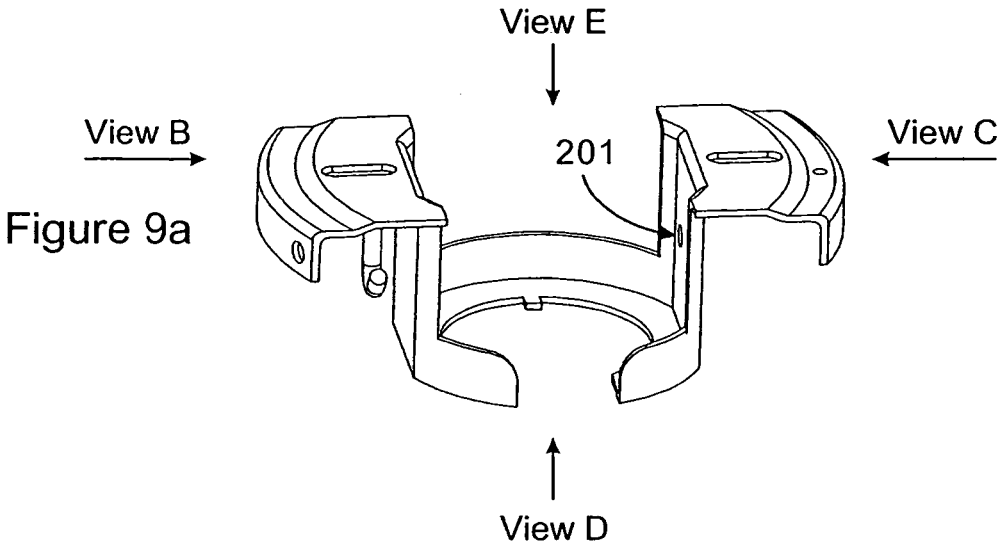
FIG. 9*a* shows a front and top perspective view of the anchoring bracket of a down-rod ceiling fan of the present invention.
Figure 9B:
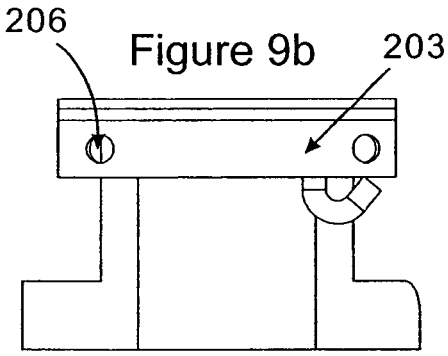
FIG. 9*b* shows a left side view of the anchoring bracket of a down-rod ceiling fan of the present invention.
Figure 9C:
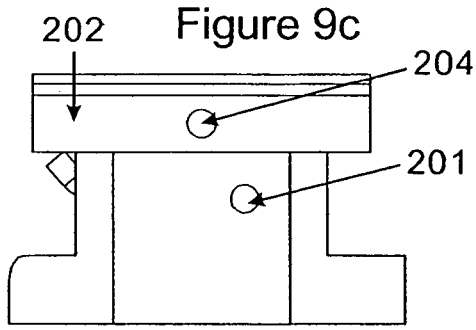
FIG. 9*c* shows a right side view of the anchoring bracket of a down-rod ceiling fan of the present invention.
Figure 9D:
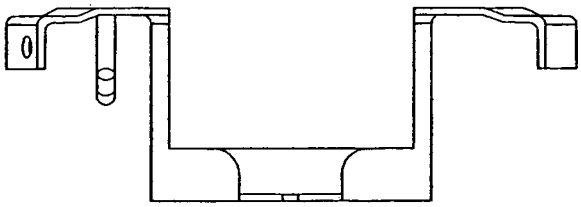
FIG. 9*d* shows a front view of the anchoring bracket of a down-rod ceiling fan of the present invention.
Figure 9E:
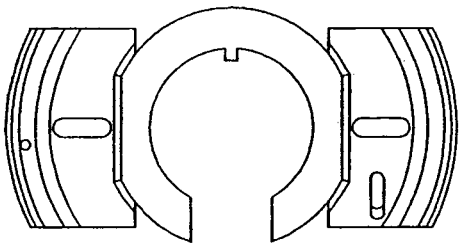
FIG. 9*e* shows a top view of the anchoring bracket of a down-rod ceiling fan of the present invention.

On the stationary locking device canopy engaging flange 202, a stationary lock-up pin receiving hole 204 is provided at around the middle of flange 202 (see FIG. 9*c*). Hole 204 receives the head portion X of stationary lock-up pin 102, which latchingly engages to the lock-up engaging hole 304 on the down-rod canopy 300 (see FIG. 8*b*).

Figure 10:
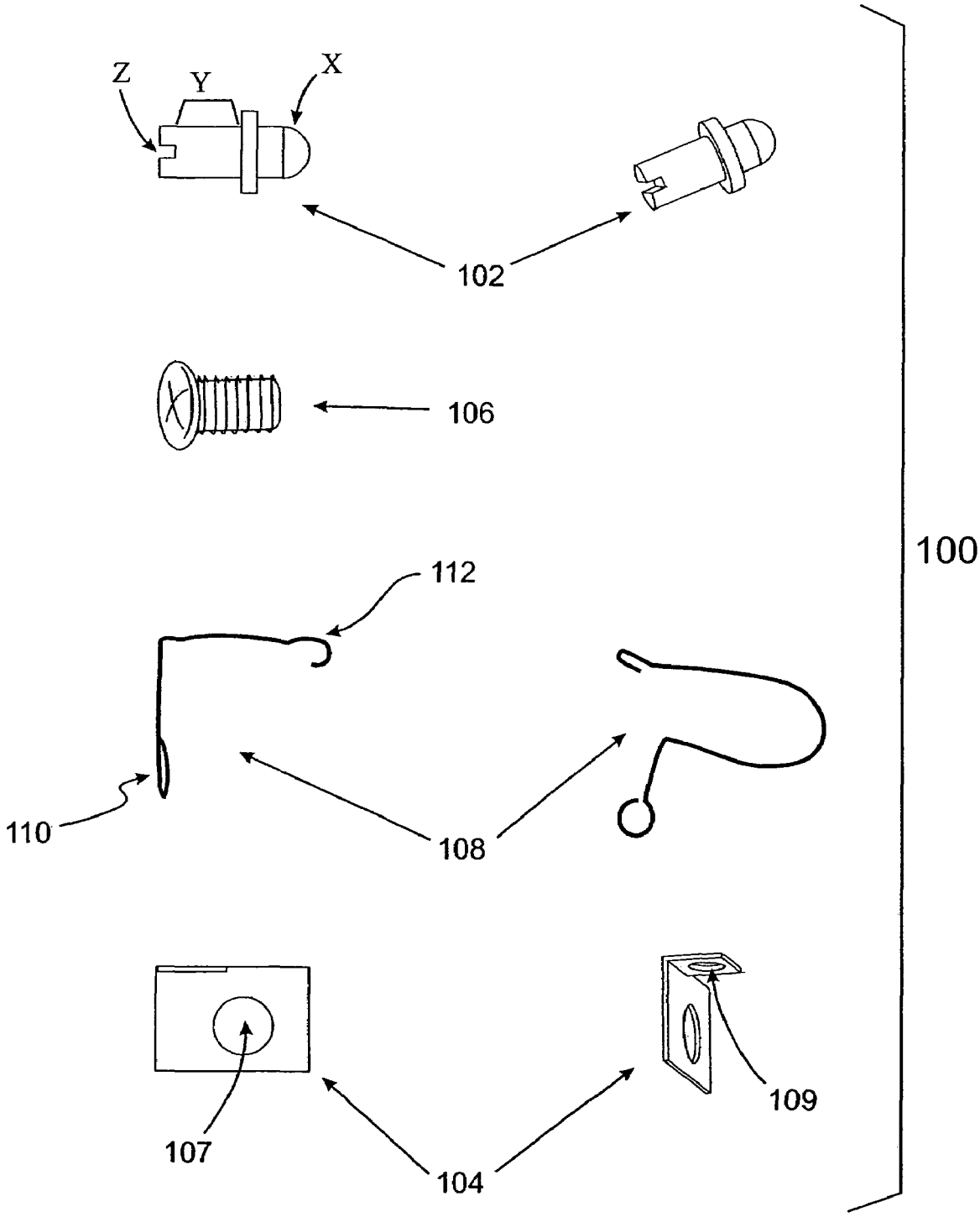
FIG. 10 shows an enlarged perspective view of the components of the locking device of the present invention for a down-rod mounted ceiling fan.
Figure 11A:
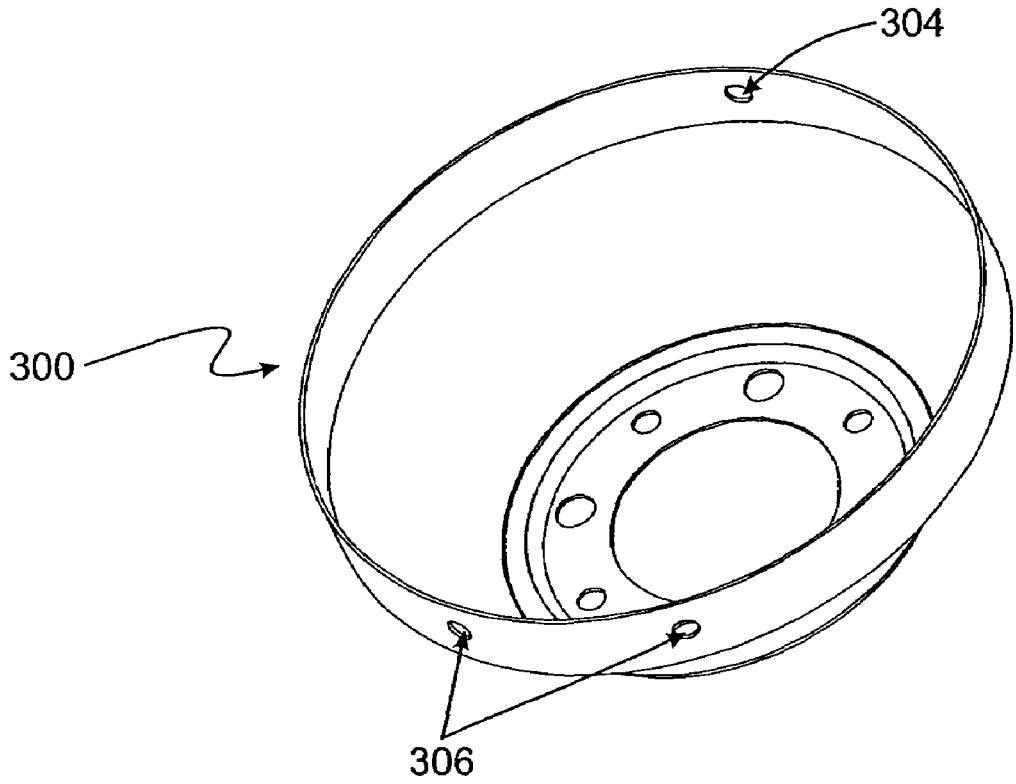
FIG. 11*a* shows a perspective view of the down-rod ceiling fan canopy of the present invention.
Figure 11B:
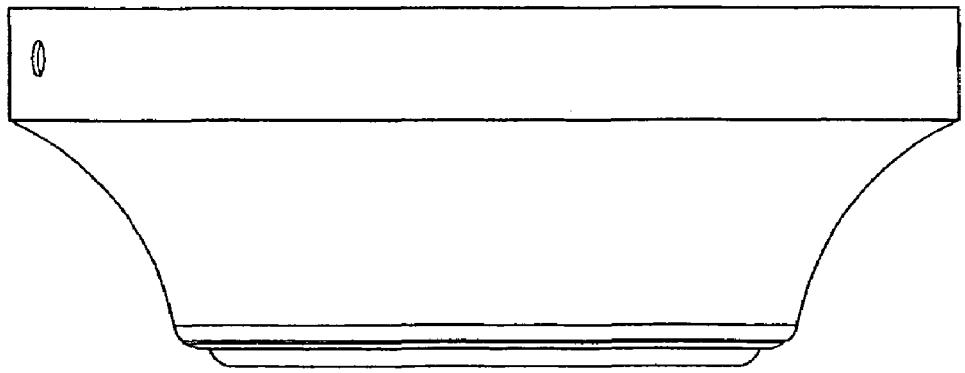
FIG. 11*b* shows a front view of the down-rod ceiling fan canopy of the present invention.
Figure 12:
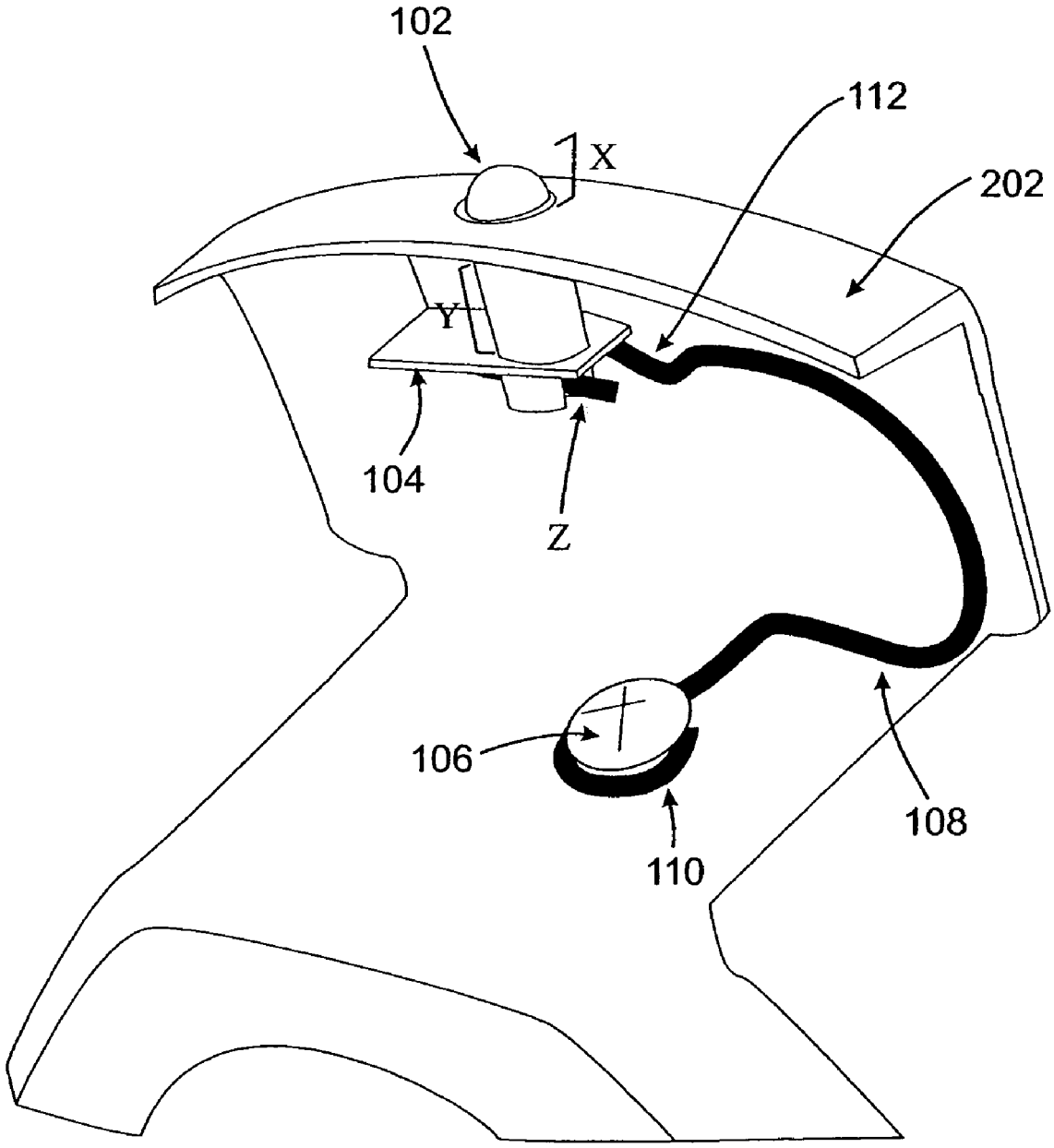
FIG. 12 shows the L-shaped resilient C-wire mounted onto the side of the anchoring bracket of a down-rod ceiling fan and cooperatively urging the stationary lock-up pin against the bracket flange.

The stationary locking device 100 is now described with reference to FIGS. 8*a*, 10 and 12. The stationary locking device 100 is comprised of a stationary lock-up pin 102 with a head portion X, a body portion Y and a relatively short tail portion Z. The head portion X takes the shape of a round-headed cone. The base of the cone connects to body portion Y after passing a connector portion with larger diameter. The connector portion keeps the body portion Y inside the stationary locking device canopy engaging flange 202. Since the dimension of the base of the head portion X is larger than the diameter of the stationary lock-up pin receiving hole 204, the head portion X is protruded outside the stationary locking device canopy engaging flange 202 through stationary lock-up pin receiving hole 204. The body portion Y is kept in place by the L-shaped locking plate 104. The tail portion Z of stationary lock-up pin 102 emerges and extends beyond the stationary lock-up pin recess 107 located on the vertical wedge of the L-shaped locking plate 104. The short tail portion Z has a shallow longitudinal slot in the middle to cooperatively and biasingly receive the urging end 112 of the L-shaped C-wire 108 (see FIG. 12). The L-shaped locking plate 104 is mounted on the under side of anchoring bracket 200 by locking plate screw 106 through locking plate screw hole 109. FIG. 10 also depicts two views of the L-shaped resilient C-wire 108 having a loop end 110 for screw 106 to fasten the C-wire to anchoring hole 201 (see also FIGS. 9*c* and 12) on anchoring bracket 200. As can be seen from FIG. 12, the L-shaped resilient C-wire 108 exerts biasing force to urge locking pin 102 against the canopy flange 202.

Figure 13A:
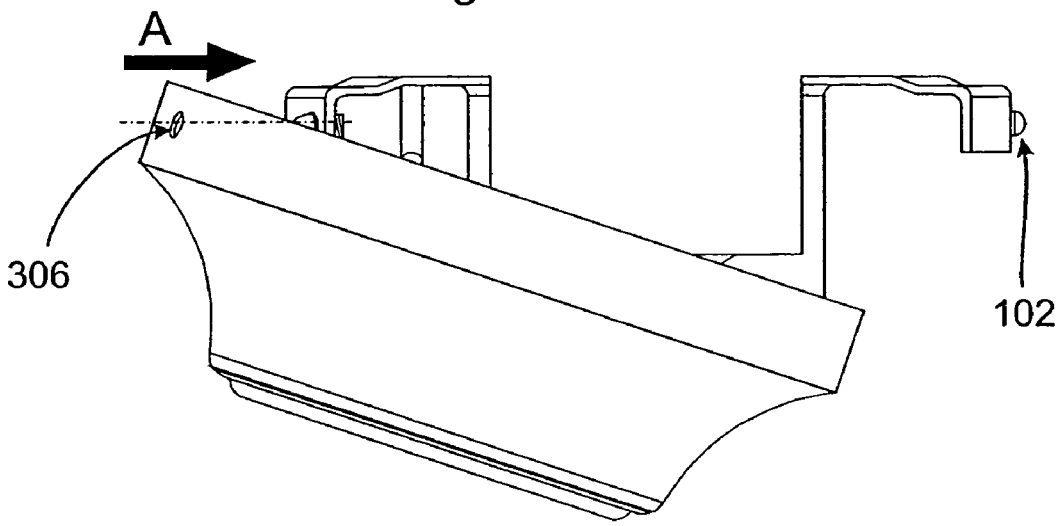
FIG. 13*a* shows the first step in installing the canopy of the down-rod fan by aligning and hooking the canopy to the hook-up pins mounted on the anchoring bracket.
Figure 13B:
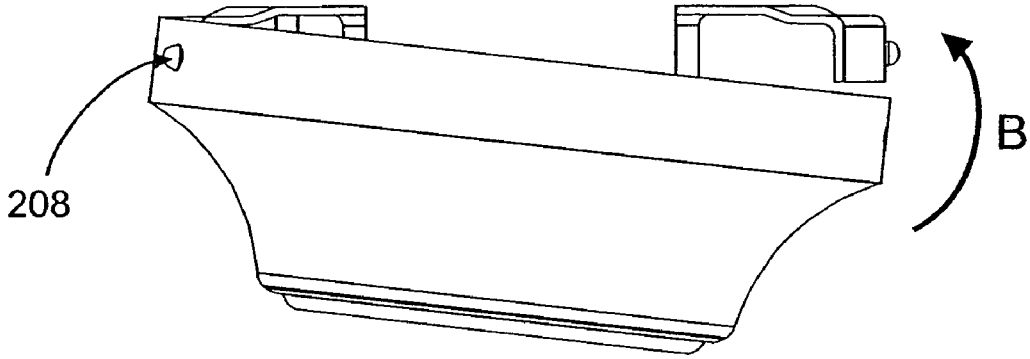
FIG. 13*b* shows the second step in installing the canopy of the down-rod fan by pushing and locking the canopy to the stationary lock-up pin mounted on the anchoring bracket.
Figure 13C:
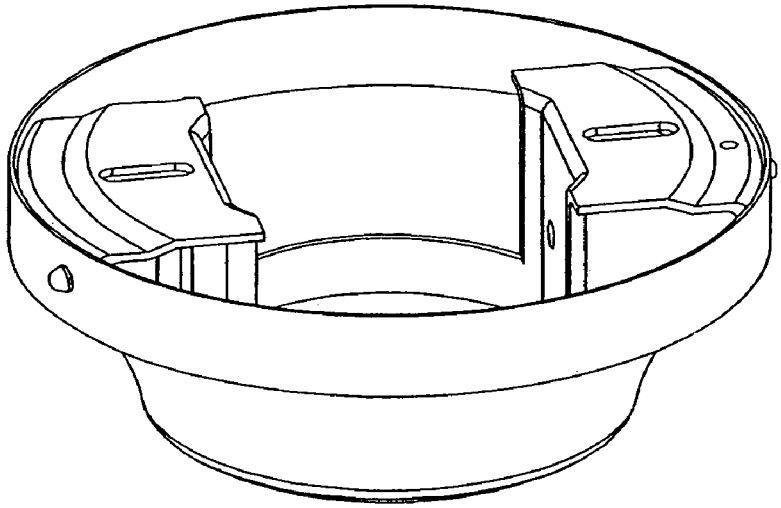
FIG. 13*c* shows the canopy of the down-rod fan securely engaged into the anchoring bracket of the present invention.

FIGS. 13*a*, 13*b* and 13*c* illustrate the relatively easy installation of the down-rod canopy 300 onto the anchoring bracket 200 using the stationary locking device 100 of the present invention. The user first aligns the two hook-up pin engaging holes 306 with the two hook-up pins 208 on ceiling anchoring plate 205 and moves the canopy towards the plate (as in the direction indicated by arrow A in FIG. 13*a*) until the pins 208 are engaged to the holes 306. Once the hook up is completed, the user then proceeds to lock up the canopy by pushing canopy 300 upward (as in the direction indicated by arrow B in FIG. 13*b*). With the upward pushing motion, the stationary lock-up pin 102 latchingly engages hole 304 on the canopy when the latter comes into contact with head portion X of stationary lock-up pin 102 on the anchoring bracket 200 and forces the head portion X of stationary lock-up pin 102 to retract (as canopy 300 is pushed up) and then to urge outward and to lock into stationary lock-up pin engaging hole 304 via the C-wire biasing action.

FIG. 13*c* shows the down-rod canopy 300 securely installed onto the anchoring bracket 200, with the hook-up pins 208 and head portion X of stationary lock-up pin 102 protruding outward from the hook-up pin engaging holes 306 and stationary lock-up pin engaging hole 304, respectively.

It is readily understood that the number of stationary lock-up pin and hook-up pin in either the hugger mounted fans or down-rod mounted fans is not limited to those disclosed herein. Likewise, any suitable biasing means able to urge the stationary lock-up pin against the stationary lock-up pin engaging hole on the housing or canopy is within contemplation of the present invention. The coil spring 18 and L-shaped resilient C-wire 108 are merely examples of preferred embodiments disclosed in this invention herein.

Hence, although the present invention has been described with referenced to two preferred embodiments, it will be appreciated by those skilled in the art that various modifications, alternations, variations, and substitutions of parts and components may be made without departing from the spirit and scope of the invention. Therefore, the present application is intended to cover such modifications, alternations, variations, and substitutions of parts and components.

What is claimed is:

1. A down-rod ceiling fan anchoring bracket and fan canopy assembly comprising:

(i) a fan anchoring bracket comprising a hook-up means, a stationary lock-up means and a stationary locking device canopy engaging flange, wherein said stationary lock-up means comprises a locking plate mounted on the anchoring bracket and a pin protruding therefrom through a L-shaped resilient C-wire; whereby a spring biasing action exerted by the lock-up means is achieved by said L-shaped resilient C-wire cooperatively urging said pin against a corresponding hole on the fan canopy and wherein said pin engages a hole in the said stationary locking device canopy engaging flange;

(ii) said hook-up means and lock-up means are mountably attached to the fan anchoring bracket and said lock-up means capable of exerting spring biasing action to lock said fan canopy in a secure position; and (iii) the fan canopy equipped with corresponding means to engage the hook-up means.

2. The assembly as claimed in claim 1, wherein said pin has a head portion in the shape of a round-headed cone and a tail portion with a shallow longitudinal slot in the middle to cooperatively and biasingly receive an urging end of the L-shaped resilient C-wire.

* * * * *